United States Patent [19]

Howard

[11] Patent Number: 4,515,367

[45] Date of Patent: May 7, 1985

[54] CARD SHUFFLER HAVING A RANDOM EJECTOR

[76] Inventor: Robert Howard, 1800 NE. 114th St. Penthouse #10, Miami, Fla. 33181

[21] Appl. No.: 457,959

[22] Filed: Jan. 14, 1983

[51] Int. Cl.[3] ..... A63F 1/12

[52] U.S. Cl. ..... 273/149 R

[58] Field of Search ..... 273/149 R

[56] References Cited

U.S. PATENT DOCUMENTS 3,899,178 8/1975 Watanabe ..... 273/149 R 4,310,160 1/1982 Willette et al. ..... 273/149 R

*Primary Examiner*—Richard C. Pinkham

*Assistant Examiner*—Leo P. Picard

*Attorney, Agent, or Firm*—Louis Weinstein

[57] ABSTRACT

In an automatic card shuffler, cards already played are placed in first and second trays. Sensors arranged in the trays detect the presence of cards to automatically initiate a shuffling operation. The cards in the trays pass through the card mixer, where they are interweaved in a random fashion and deposited in a compartment arranged beneath the mixer. A carriage carrying a card ejector is reciprocated up and down by a reversible linear drive, activated when the shuffling operation begins and terminated substantially upon termination of the shuffling operation to locate the card ejector at a randomly determined position along the card receiving stack. If the stack of cards in said compartment reaches at least a minimum predetermined height, detected by a sensor arranged within the compartment, the card ejector is moved into the compartment to eject a group of cards, preferably of the order of two decks. The aforesaid ejected group of cards may then be placed in a dealing shoe. The random selection of a group of cards within the card compartment may be controlled by a solid state electronic random generator comprised of either discrete solid state components or a microprocessor. In another alternative embodiment, the randomly ejected group of cards is automatically transferred to the dealing shoe.

31 Claims, 15 Drawing Figures

CARD SHUFFLER HAVING A RANDOM EJECTOR

FIELD OF THE INVENTION

The present invention relates to card shufflers, and more particularly to automatic card shufflers for randomly ejecting a group of cards from a stack of previously mixed cards.

BACKGROUND OF THE INVENTION

Certain card games employ a plurality of decks, and in some instances as many as six to eight decks. The decks are thoroughly shuffled when first opened and are thereafter typically placed in a dealing shoe from which the cards are dispensed. When all of the cards in the shoe have been exhausted, the decks are reshuffled and again replaced in the dealing shoe. The reshuffling operation is a slow, time consuming and tedious process, due to the number of cards to be shuffled. Also, the shuffling operation is presently done manually.

BRIEF DESCRIPTION OF THE INVENTION

The present invention is characterized by comprising an automatic card shuffler, including a card mixer for receiving cards to be shuffled in first and second trays. Sensors detect the presence of cards in these trays to automatically initiate a shuffling operation, in which the cards are conveyed from the trays to a card mixer, which randomly interleaves the cards delivered to the mixing mechanism and deposits the interleaved cards in a vertically aligned card compartment.

A carriage supporting an ejector is reciprocated back and forth in a vertical direction by a reversible linear drive while the cards are being mixed, to constantly move the card ejector along the card receiving compartment. The reversible linear drive is preferably activated upon activation of the mixing means and operates simultaneously with, but independently of, the mixing means. When the shuffling operation is terminated, the linear drive is deactivated thereby randomly positioning the card ejector at a vertical location along the card receiving compartment.

A sensor arranged within the card receiving compartment determines if the stack of cards has reached at least a predetermined vertical height. After the card ejector has stopped and, if the sensor in the compartment determines that the stack of cards has reached at least the aforesaid predetermined height, a mechanism including a motor drive, is activated to move the wedge-shaped card ejector into the card receiving compartment for ejecting a group of the cards in the stack, the group selected being determined by the vertical position attained by the wedge-shaped card ejector.

In one preferred embodiment, the card ejector pushes the group of cards engaged by the ejector outwardly through the forward open end of the compartment, said group of cards being displaced from the remaining cards of the stack, but not being completely or fully ejected from the stack.

The card ejector, upon reaching the end of its ejection stroke, detected by a microswitch, is withdrawn from the card compartment and returned to its initial position in readiness for a subsequent shuffling and card selecting operation.

An alternative technique for randomly selecting the group of cards to be ejected from the card compartment utilizes solid state electronic circuit means, which may comprise either a group of discrete solid state circuits or a microprocessor, either of which techniques preferably employ a high frequency generator for stepping a N-stage counter during the shuffling operation. When the shuffling operation is completed, the stepping of the counter is terminated. The output of the counter is converted to a DC signal, which is compared against another DC signal representative of the vertical location of the card ejector along the card compartment.

In another alternative embodiment, a random selection is made by incrementing the N-stage counter with a high frequency generator. The high frequency generator is disconnected from the N-stage counter upon termination of the shuffling operation. The N-stage counter is then incremented by a very low frequency generator until it reaches its capacity count and resets. The reciprocating movement of the card ejector is terminated after completion of a time interval of random length and extending from the time the high frequency generator is disconnected from the N-stage counter to the time that the counter is advanced to its capacity count and reset by the low frequency generator, triggering the energization of the reciprocating drive, at which time the card ejector carriage coasts to a stop.

In one preferred embodiment, the card ejector partially ejects a group of cards from the stack in the compartment. The partially displaced group of cards is then manually removed from the compartment. In another preferred embodiment, the ejector fully ejects the group of cards from the compartment, the ejected cards being dropped into a chute, which delivers the cards directly to a dealing shoe. The pressure plate of the dealing shoe is initially withdrawn to a position enabling the cards passing through the delivery shoe to enter directly into the dealing shoe, and is thereafter returned to its original position at which it urges the cards towards the output end of the dealing shoe.

OBJECTS OF THE INVENTION AND BRIEF DESCRIPTION OF THE FIGURES.

A primary object of the present invention is to provide automatic card shuffling apparatus for selecting a group of cards at random from a card stack.

Still another object of the present invention is to provide an automatic card shuffling apparatus utilizing electrical means for assuring random selection of a group of cards from a card stack.

Still another object of the present invention is to provide novel card shuffling apparatus for randomly selecting a group of cards from a stack and automatically delivering the cards to a dealing shoe.

The above, as well as other objects of the present invention, will become apparent when reading the accompanying description and drawing in which:

FIG. 1 is a perspective view showing a card shuffling apparatus embodying the principles of the present invention.

FIG. 1*a* shows a detailed perspective view of a sensor employed in each of the trays shown in the shuffling apparatus of FIG. 1.

FIG. 2 is a top view of the card stacking compartment of FIG. 1.

FIG. 2*a* is a perspective view showing the light source and light sensor arrangement employed in the stacker compartment of FIG. 2.

FIG. 3*b* is a rear elevational view showing the mechanical assemblies for the card shuffler of FIG. 1.

FIGS. 3*a* and 3*c* are top and end views of the mechanical assemblies shown in FIG. 3*b*.

Figure 5:
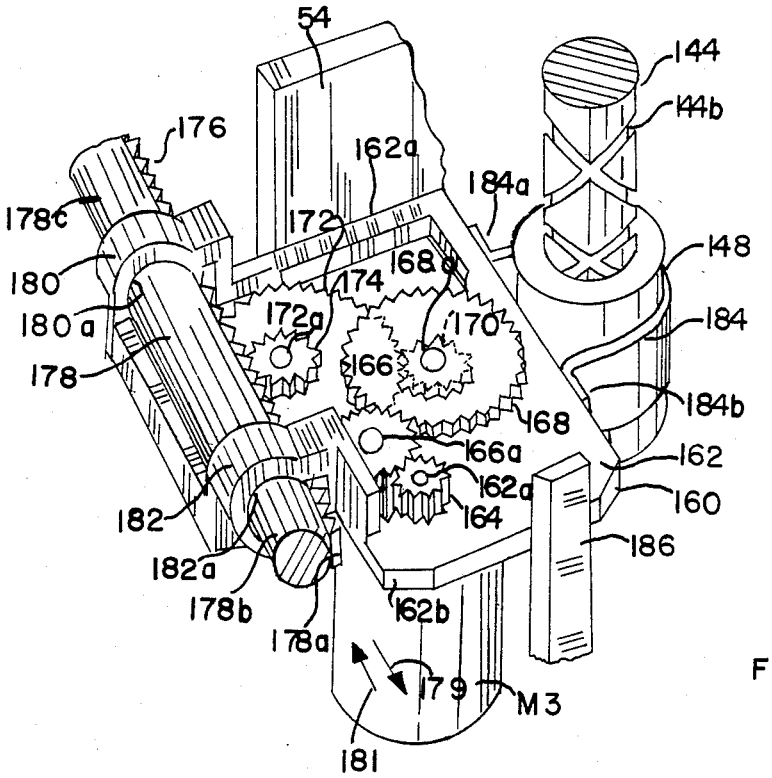
FIG. 5 shows the pusher rack and pinion drive of FIG. 3*a* in greater detail.
Figure 5A:
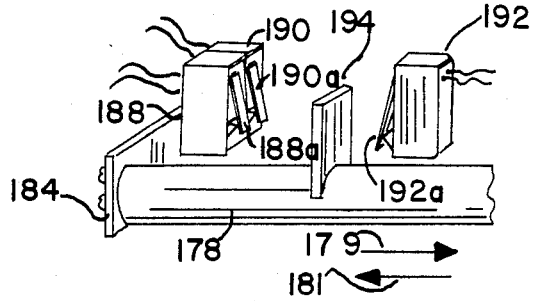

FIG. 5*a* shows how reciprocating action of the projection means activates the control switches.

Figure 3A:
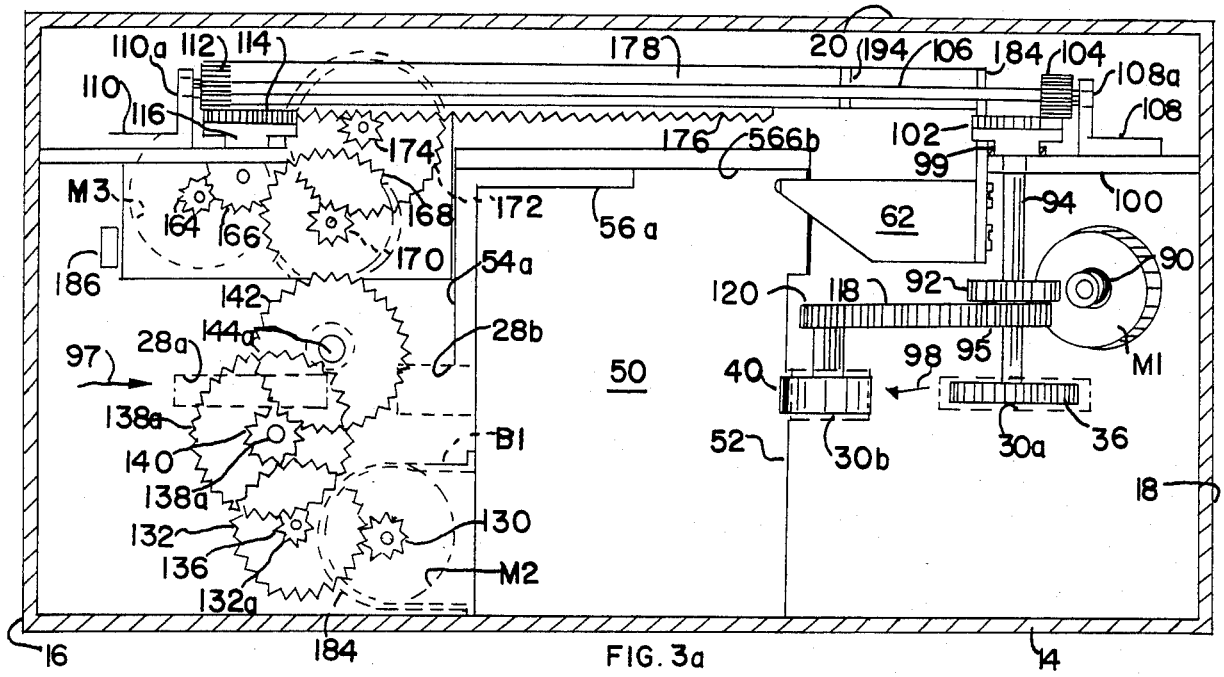
Figure 6:
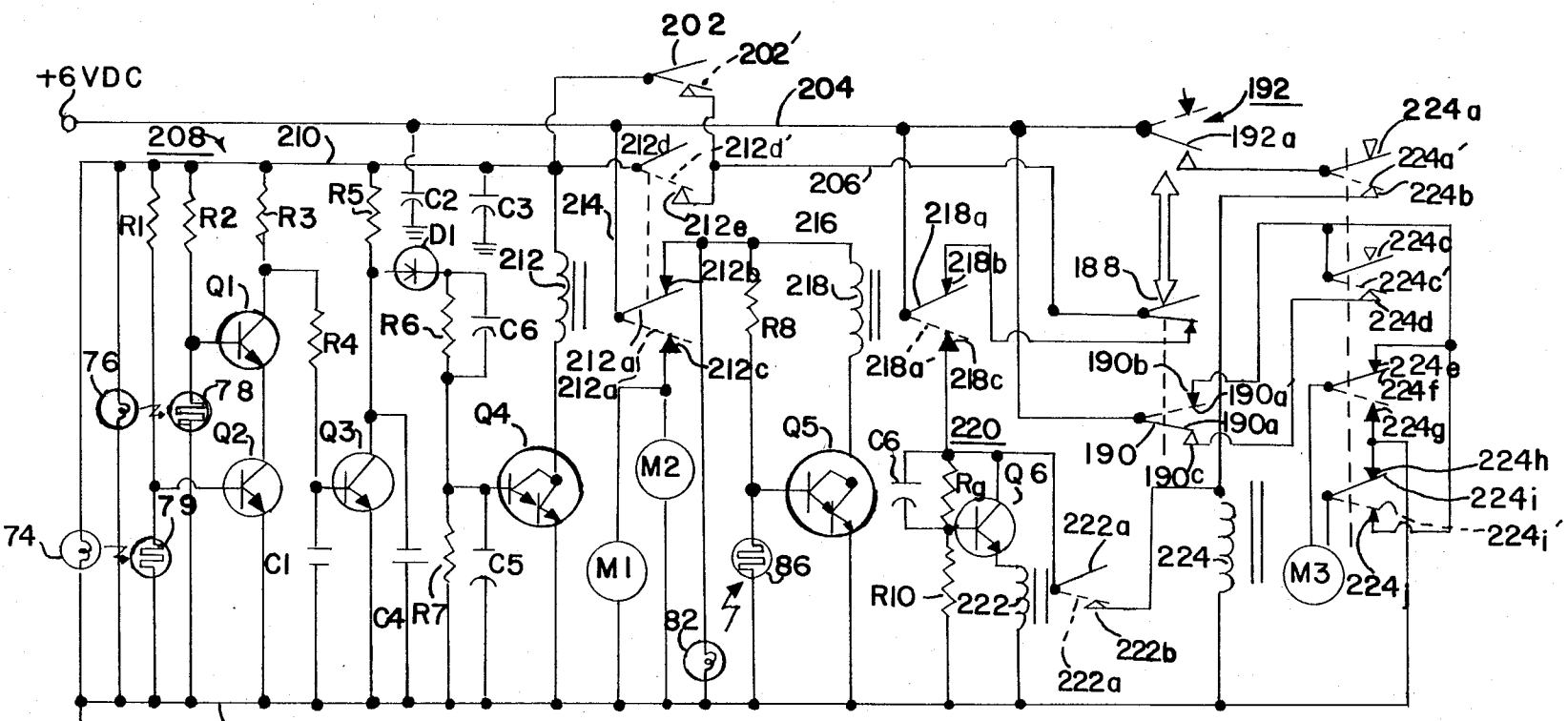

FIG. 6 shows an electrical schematic for controlling the mechanical assemblies shown in FIG. 3*a*.

Figure 6A:
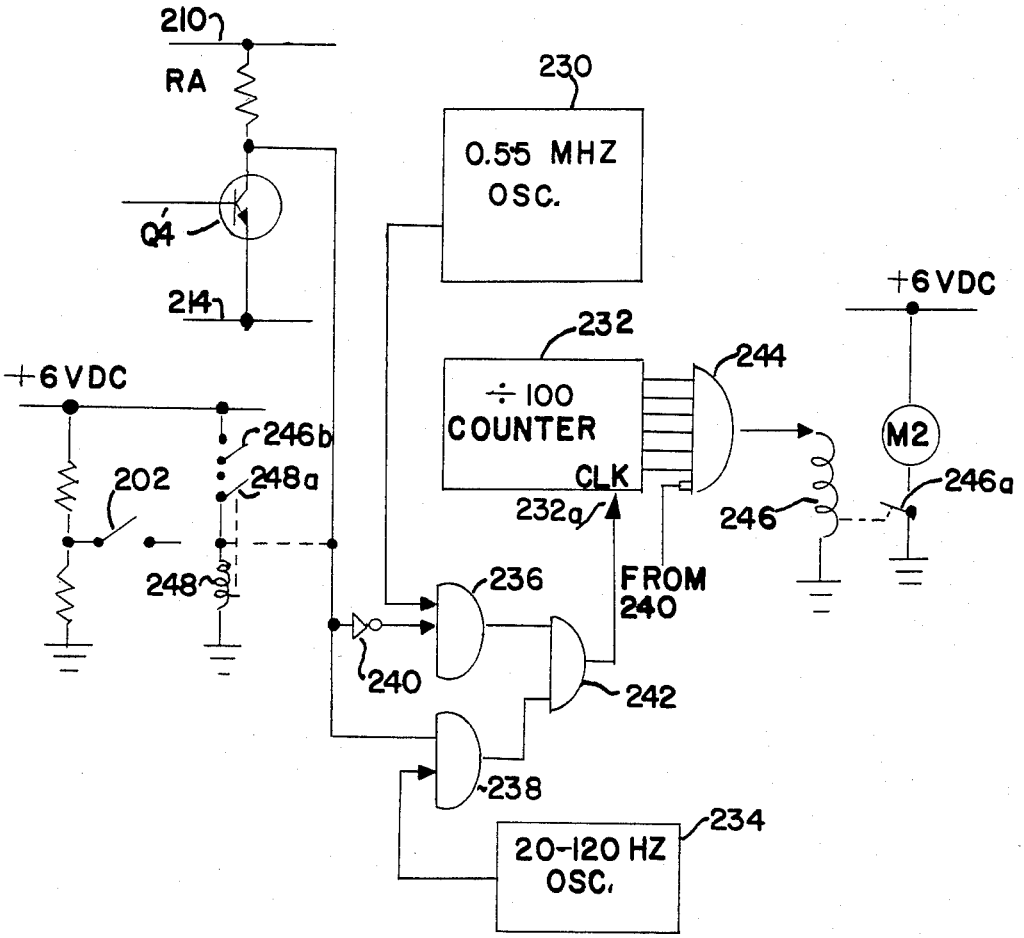
Figure 6B:
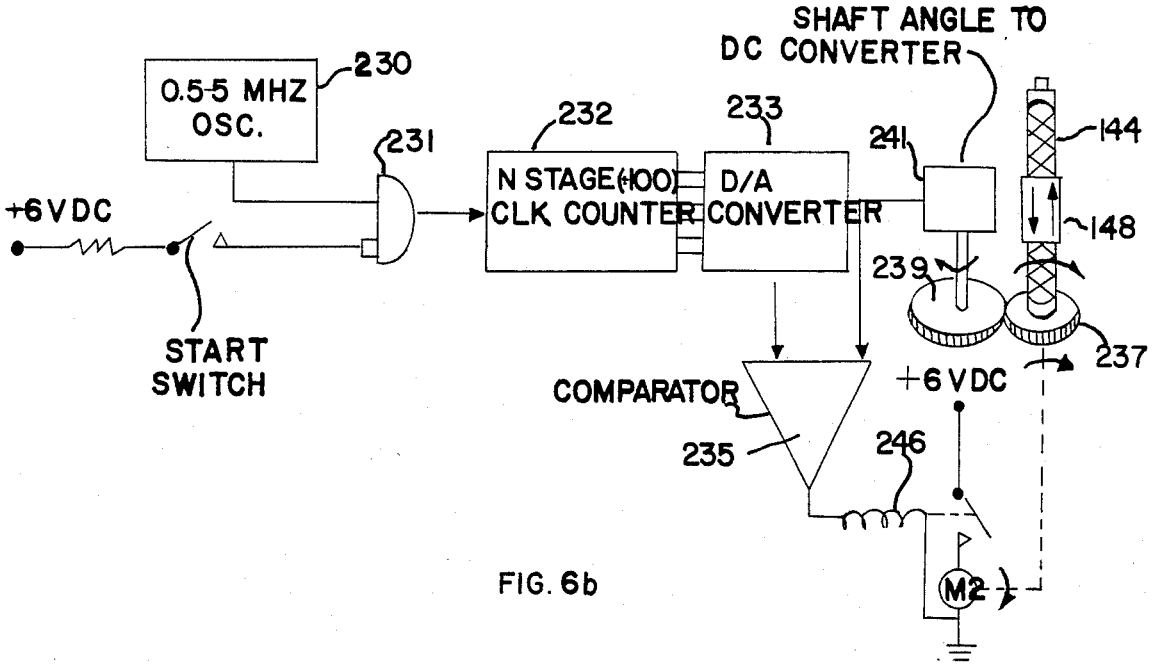

FIGS. 6*a* and 6*b* show alternative embodiments for the electronics which may be employed to operate the mechanical assemblies of FIG. 3*a*.

Figure 7:
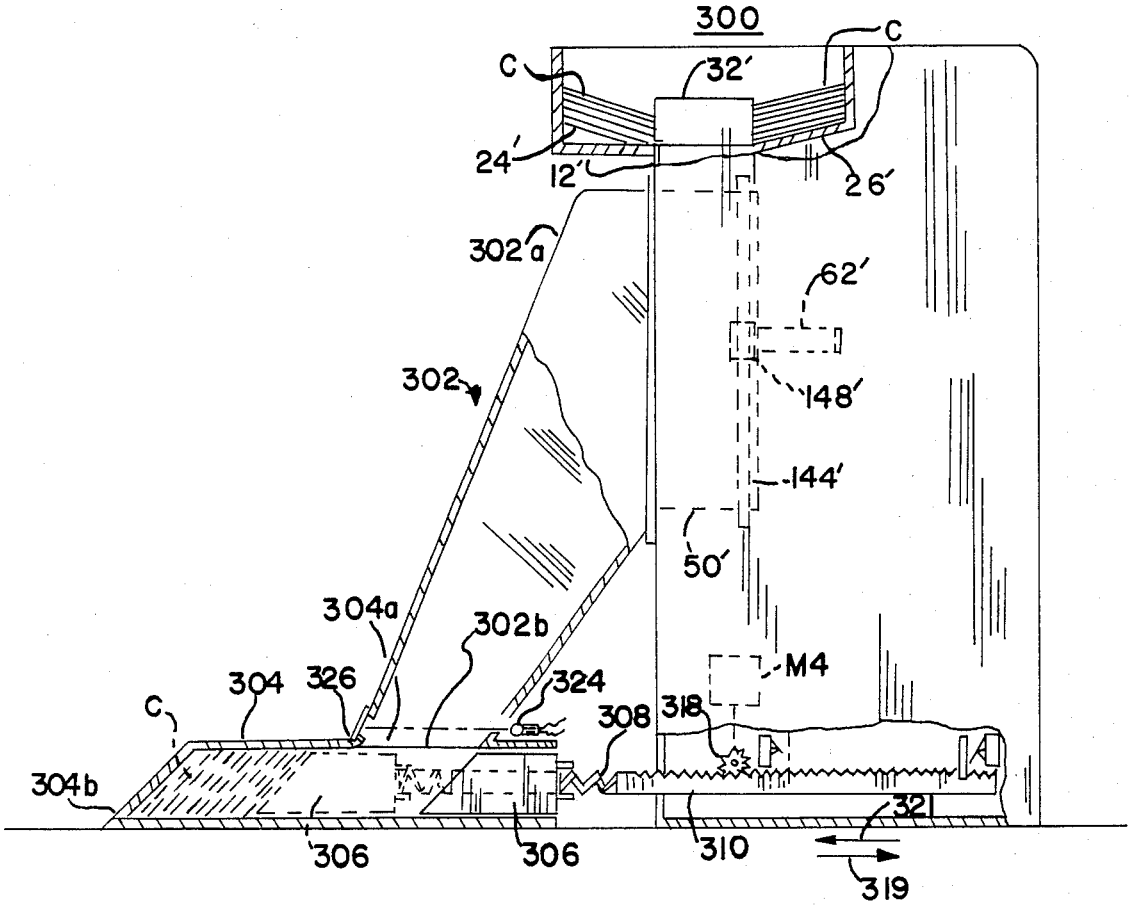

FIG. 7 shows a side elevational view of another embodiment of the present invention.

Figure 8:
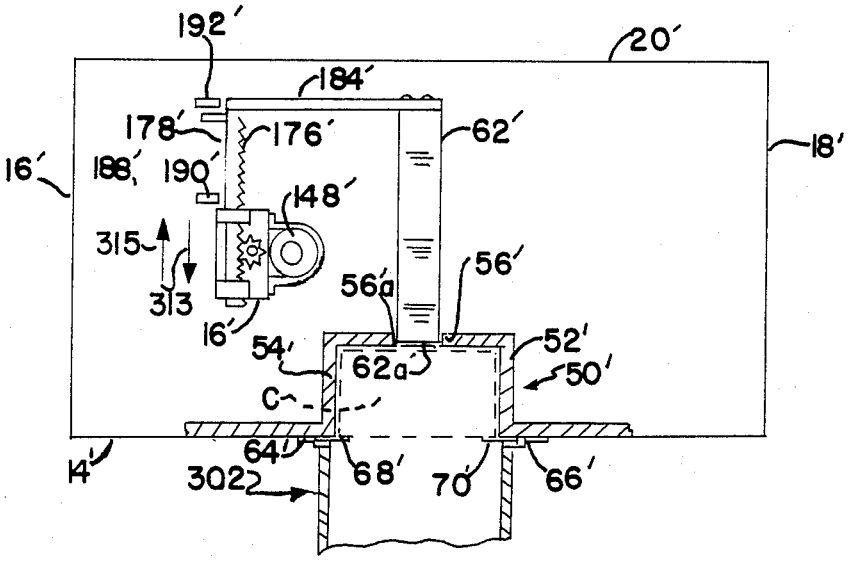

FIG. 8 shows a top plan view of the mechanism for moving the pusher of FIG. 7.

DETAILED DESCRIPTION OF THE INVENTION AND PREFERRED EMBODIMENTS THEREOF.

Figure 1:
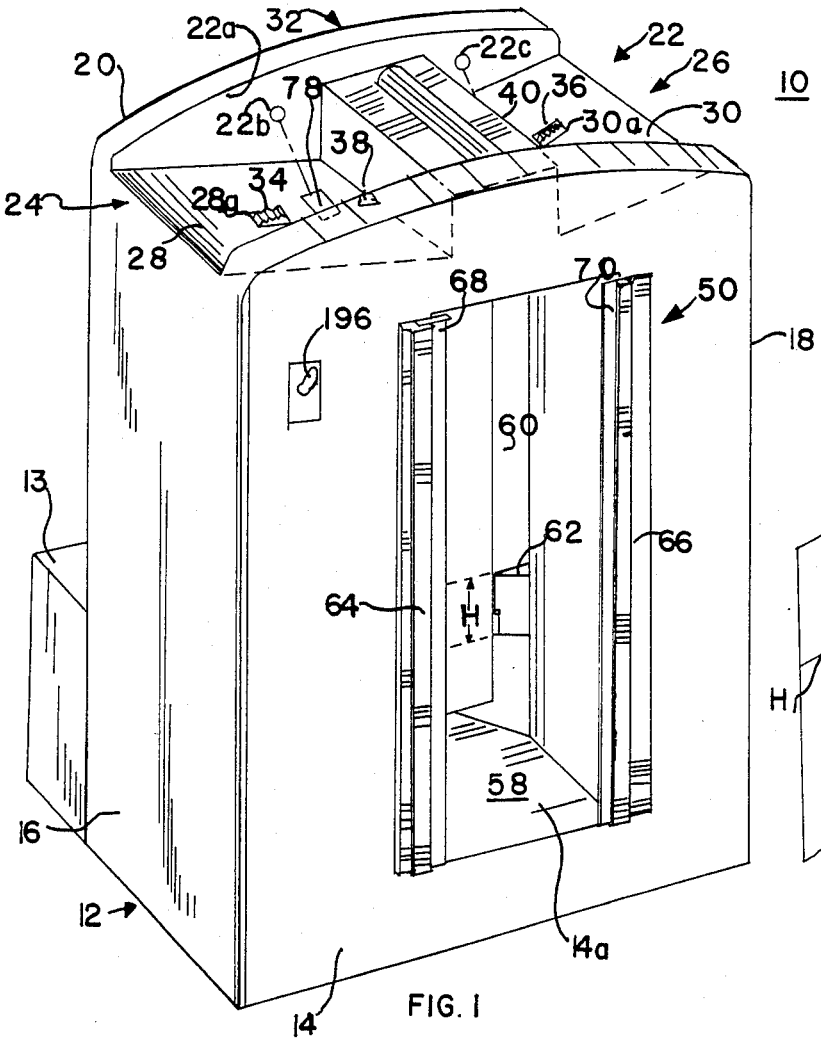
Figure 2A:
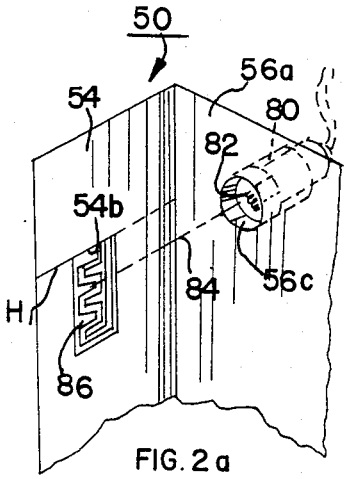
Figure 2:
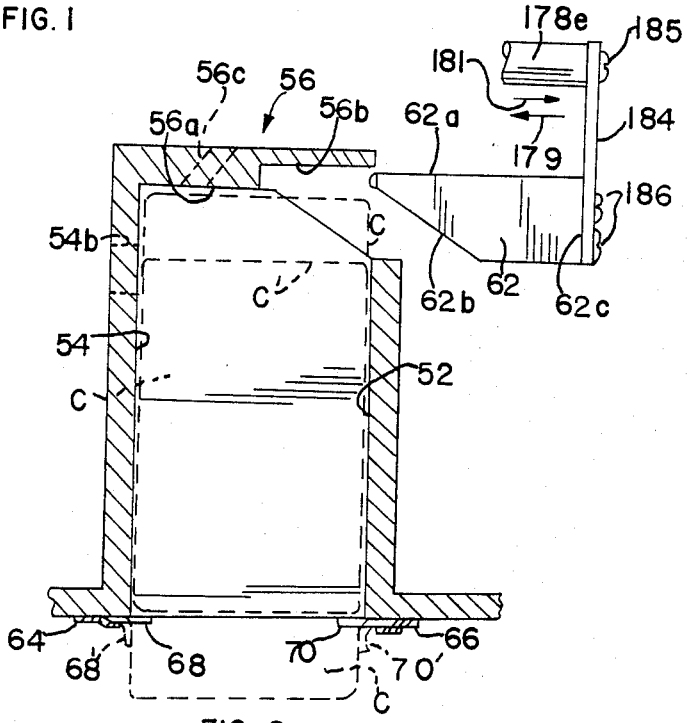

FIGS. 1 through 2*a* show an automatic shuffler 10 designed in accordance with the principles of the present invention and comprised of a housing 12, having a front wall 14, side walls 16 and 18, rear wall 20, and a top 22.

Front wall 14 is provided with an elongated, rectangular-shaped opening 14*a*, which defines a card stacking compartment 50 for receiving and supporting a large stack of cards, which is typically of the order of four to six playing decks. Cards are stored and a group thereof is randomly dispensed from compartment 50 in a manner to be more fully described.

The top 22 of housing 20 is provided with first and second tray portions 24 and 26, having surfaces 28 and 30 for supporting cards to be shuffled. Receiving trays 24 and 26 are arranged on opposite sides of a shuffler mechanism 32, which is designed to interleave the cards alternately fed thereto by trays 24 and 26, and to drop the interleaved cards into the cart stack compartment 50. Shuffler mechanism 32 is of conventional design, and any suitable shuffler mechanism presently available in the marketplace may be utilized. One such mechanism is the Automatic Shuffler, Item No. F-73627, which item is available from the Spencer Gifts Catalog, of Atlantic City, N.J.

Each of the tray surfaces 28 and 30 is provided with an opening 28*a*, 30*a*. Rotating card advancing members periodically protrude through openings 28*a*, 30*a*, in an alternating fashion to alternately feed the bottom card of each of the trays 24, 26 to shuffling mechanism 32. Additional roller assemblies 38, 40, only roller 38 being visible in FIG. 1, feed the bottom card of its associated tray and advanced by its associated advancing member 34, 36, into the shuffling mechanism.

The shuffling mechanism drops the interleaved cards into the top of card stack compartment 50 to build a stack of cards therein.

The card stack compartment 50 is comprised of right-hand side wall 52, left-hand side wall 54, rear wall 56, and floor 58. Wall 52 is provided with an elongated vertically aligned rectangular-shaped slot 60, through which card ejector 62 periodically protrudes for purposes of ejecting a randomly selected group of cards from the stack, as will be more fully described herein.

Front wall 14 of housing 12 is provided with a pair of substantially Z-shaped flanges 64, 66, each of which forms an elongated slot or groove with front face 14, for receiving the respective left-hand and right-hand marginal portions of elongated resilient rubber or rubber-like strips 68, 70, which overlie the vertical edges of opening 14*a*, and which serve to retain the cards stacked in the compartment and also to permit only those cards selected for ejection to be ejected from compartment 50 and preventing cards above and below the ejected group from being displaced.

Stacker compartment rear wall 56 has a portion 56*a* projecting inward into the compartment and away from wall surface 56*b* to displace the rear edge of cards C shown in dotted line fashion in FIG. 2 from rear wall surface portion 56*b*. Surface 62*a* of card ejector 62 moves along surface 56*b*, when entering into the compartment 50. The projection 56*a* assures that the diagonally aligned surface 62*b* of card ejector 62 moves behind the cards C in the compartment to assure smooth, positive ejection of the cards, as will be more fully described.

Figure 1A:
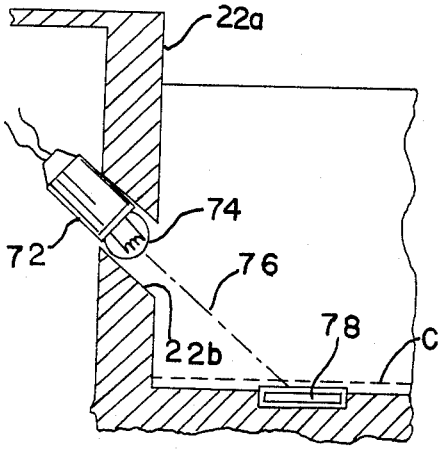

Each of the trays 24, 26 includes a side wall 22*a*, having a generally cylindrical-shaped opening 22*b*, 22*c*. One such opening, opening 22*b* as shown in detail in FIG. 1*a*, and comprises a substantially cylindrical-shaped opening whose longitudinal axis is inclined at an angle. A socket assembly 72 carries a lamp 74, which may be a conventional lamp or a light emitting diode (LED) arranged with an opening 22*b* to direct light diagonally downward as shown by light ray 76. Light from LED 76 is directed to a light-sensitive element 78, whose resistivity increases with decreasing light. The light ray 76 is blocked from reaching light-sensitive element 78 when one or more cards C are placed in the tray 24 in the manner shown in FIG. 1*a*. The light sources and cooperating light-sensitive elements of both trays 24 and 26 operate in substantially the same manner.

The rear wall 56*a* (see FIGS. 2 and 2*a*) of card stacking compartment 50 is provided with a similar type of cylindrical-shaped opening 56*c*, whose longitudinal axis is aligned diagonally to the vertical axis and is further aligned diagonally relative to side wall 54. A lamp socket 80 is positioned within cylindrical-shaped opening 56*c* and supports a lamp (or LED) 82, which directs light diagonally downward, as shown by ray 84 toward light-sensitive element 86 positioned behind opening 54*b* inside wall 54. The light rays are blocked from reaching light-sensitive element 86 when the stack of cards reaches a height represented by dotted line $H_1$, which is sufficient to cover light-sensitive element 86.

Figure 3C:
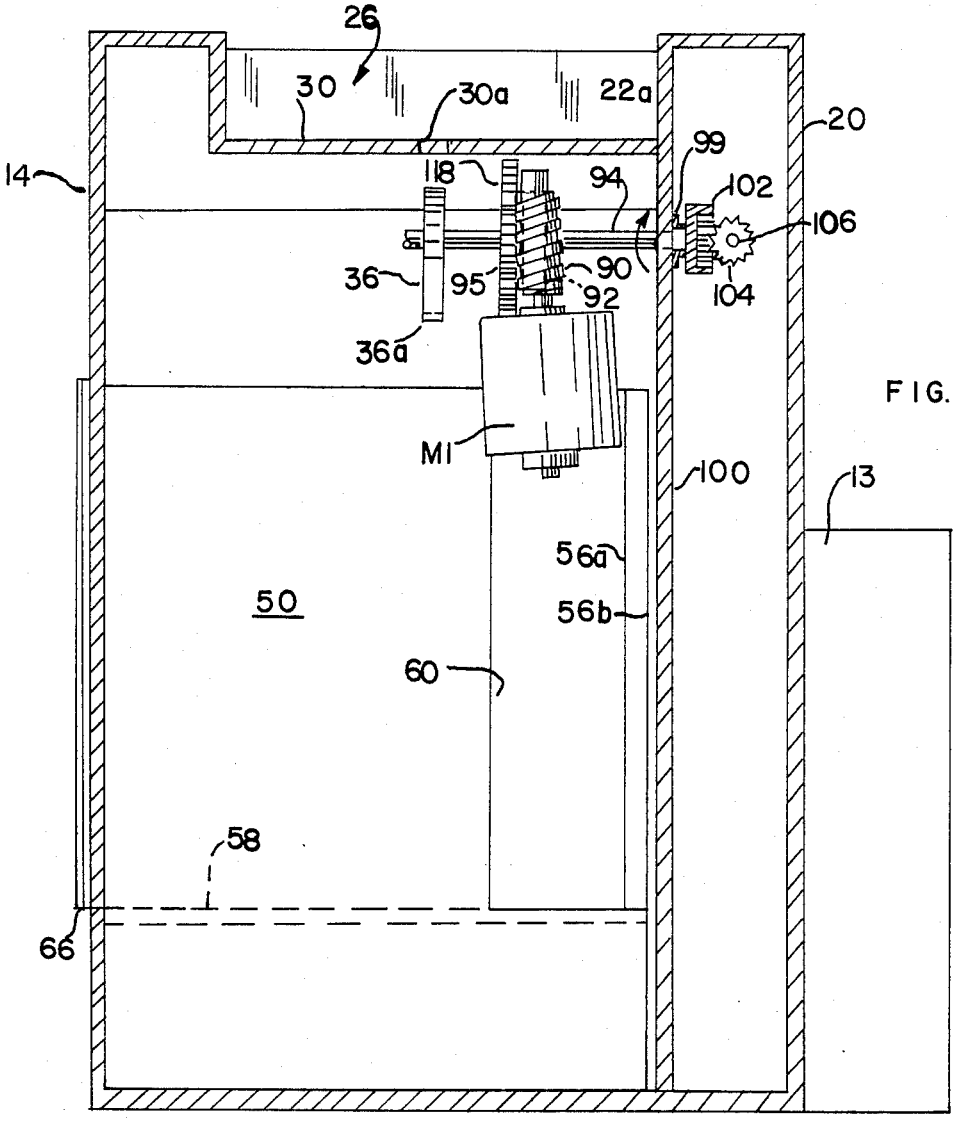
Figure 3B:
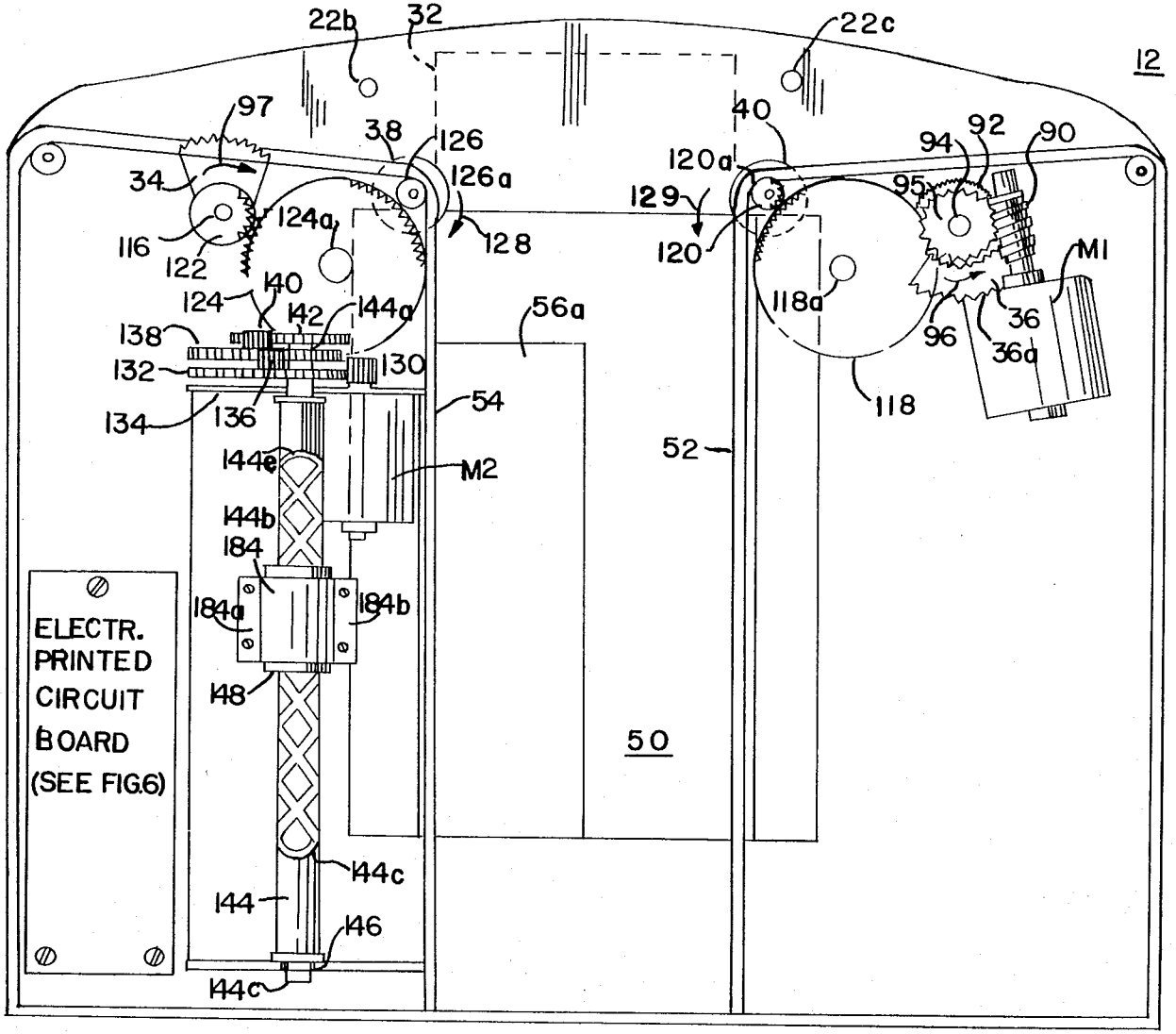

FIGS. 3*a*, 3*b* and 3*c* show top, rear and side elevational views, respectively, of the shuffler apparatus 10 shown in FIGS. 1 through 2*a*. The top plan view of FIG. 3*a* shows the openings 28*a* and 30*a* through which the eccentric advancing members 34 and 36 periodically extend, and further shows openings 28*b* and 30*b* through which the rollers 38 and 40 extend.

A motor M1 (note especially FIGS. 3*b* and 3*c*) is mounted in the right-hand portion of housing 12, as shown in FIG. 3*b*. A worm gear 90 is mounted upon the output shaft of motor M1 and meshes with gear 92, mounted upon shaft 94. Advancing member 36 is mounted upon shaft 94 to rotate responsive to rotation of gear 92 and has a pie-shaped configuration provided with a v-shaped pattern along its arcuate periphery 36*a*. Member 36 rotates in the direction shown by arrow 96 and its grooved peripheral portion 36 periodically extends through opening 30*a* to advance the bottom card in the tray 26 in the direction shown by the arrow 98 in FIG. 3*a*.

Shaft 92 extends towards the right as shown in FIG. 3*c* and is journaled within bearing 99 provided in vertical partition 100. The right-hand end of shaft 92 carries a cup-shaped gear 102, which meshes with a gear 104 mounted upon one of a slender elongated shaft 106 journaled within an opening 108*a* provided in supporting bracket 108 and further journaled within an opening 110*a* in bracket 110, which brackets are secured to vertical partition 100. The end of slender elongated shaft 106 adjacent to bracket 110 supports a second gear 112, secured thereto and meshing with a second cup-shaped gear 114, mounted to rotate shaft 116 upon which advancing member 34 is mounted. Thus, by energizing Motor M1, the advancing members 34 and 36 are caused to rotate in the directions shown by arrows 96 and 97. Members 36, 38 are arranged as shown to alternately advance cards in their respective trays towards mixer 32.

A second gear 95 integral with gear 92, meshes with a larger diameter gear 118 mounted to rotate upon shaft 118*a*. Gear 118 meshes with gear 120 mounted to rotate with shaft 128, which carries roller 40. Similarly, shaft 116 carries gear 122, which meshes with larger diameter gear 124 mounted to rotate about shaft 124*a*. Smaller diameter gear 126 meshes with gear 124 for rotation with shaft 126*a* to, in turn, rotate roller 38. Rollers 38 and 40 rotate in the directions shown by arrows 128 and 129, respectively, so long as motor M1 is energized.

Figure 4:
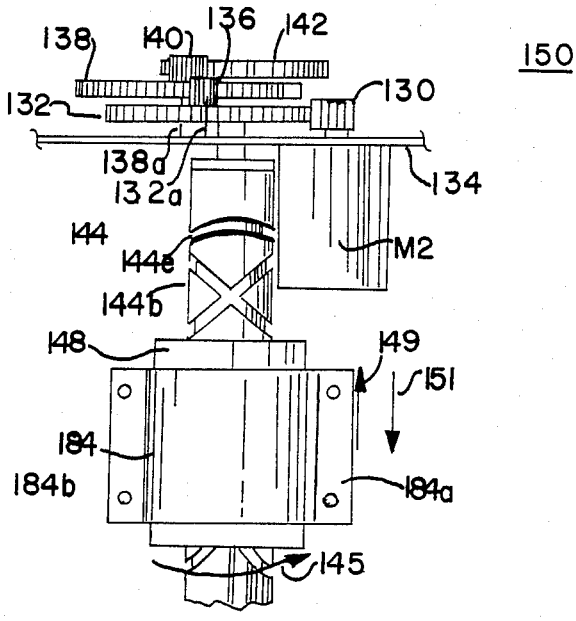
FIG. 4 shows the bi-direction worm drive of FIG. 3*a* in greater detail.

A motor M2, shown best in FIGS. 3*a* and 4, is mounted by a bracket B1 to the left-hand surface of compartment side wall 54 (note FIGS. 2 and 3*a*). A pinion gear 130 is mounted to the output shaft of motor M2, and meshes with gear 132 mounted to rotate upon shaft 132*a*, which is supported by internal shelf 134. A gear 136 integral with gear 132 and rotating therewith, meshes with gear 138 rotatable upon shaft 138*a* supported by shelf 134. Gear 140, which is integral with gear 138 and rotates therewith, meshes with a gear 142 secured to the upper end 144*a* of an elongated screw 144, having a double helix pattern 144*b*, grooved in its peripheral surface, forming diamond-shaped pattern 114*b*. The lower end 144*c* of screw 144 is journaled within a bearing 146.

Screw 144 is rotated in one constant angular direction. This rotation is converted into linear reciprocating motion by means of barrel 148, which encircles screw 144 and is provided with a plurality of balls arranged within a cage assembly (not shown) within barrel 148, which balls cooperate with the diamond-shaped grooved pattern 144*b* in screw 144 to move barrel 148 in a reciprocating fashion. In operation, as screw 144 rotates in the direction shown by arrow 145, barrel 148, which is restrained from experiencing any rotational movement due to its mounting to the card ejector carriage assembly 160 (to be more fully described), moves vertically upward, as shown by arrow 149 until the balls carried within barrel 148 reach the turn-around, or reverser, groove portion 144*e*, causing barrel 148 to move vertically downward as shown by arrow 151. A similar reversing action occurs when barrel 148 reaches the turn-around groove 144*c* near the bottom of screw 144, causing the barrel to stop its downward movement, shown by arrow 151, turn around and move vertically upward, as shown by arrow 149. This reciprocating action continues indefinitely, so long as motor M2 is energized.

The reciprocating action may be obtianed through using mechanisms presently available in the marketplace. For example, the reciprocating assembly 150 may utilize the Ball Reverser mechanism manufactured by Norco, Inc., of Georgetown, Conn. Obviously, any other reciprocating mechanism may be employed, if desired.

The reciprocating action of barrel 148 is imparted to carriage assembly 160, which imparts the reciprocating action to card ejector 62, as will be more fully described.

FIG. 5 shows the carriage assembly 164 positioning card ejector 162 at the randomly selected location and for reciprocating the card ejector 62 into and out of compartment 50. Carriage assembly 160 is comprised of a platform 162. Motor M3 is secured to the underside of platform 162 and has its output shaft 162*a* extending upwardly through platform 162. Pinion gear 164 is mounted upon shaft 162*a* and meshes with gear 166 arranged to rotate about shaft 166*a*, also mounted upon shelf 162. Gear 166 meshes with a larger diameter gear 168 arranged to rotate about shaft 168*a*, which is secured to shelf 162.

Gear 170, which is integral with gear 168, and is positioned beneath gear 168, meshes with larger diameter gear 172 mounted for rotation upon shaft 172*a*, which is mounted upon shelf 162. Pinion 174, which is integral with gear 172, and which is arranged upon gear 172, meshes with a rack 176 arranged along the flat 178*a* provided along one vertical surface of elongated shaft 178, which extends through eyelet-shaped openings 180*a* and 182*a* provided in projections 180 and 182, forming an integral part of the forward end of carriage assembly shelf 162. The circular-shaped portion of each opening 180*a*, 182*a* slidably receives and supports shaft 178, while the rectangular-shaped portion of each eyelet slidably receives the rack 176 secured to the flat 178*a* provided on shaft 178.

Barrel 148 is secured to the rear surface of platform 162 by bracket 184, which securely embraces barrel 148, and is provided with flanges 184*a*, 184*b* secured to shelf 162 by suitable fastening members (not shown). The sides 162*a*, 162*b* of carriage assembly 160 are guided between vertical wall 54 (note FIGS. 2, 3*a* and 3*b*) and a vertically-aligned post 186, arranged within housing 12 to permit carriage assembly 160 to move freely up and down while preventing the carriage from experiencing any movement in the horizontal direction, thereby preventing barrel 148 of reciprocating drive assembly 150 from experiencing any rotation, and thereby limiting movement of barrel 148 in either the upward or downward vertical direction to reciprocate carriage assembly 160.

Energization of Motor M3 in a first direction by applying DC voltage of a first polarity causes rack 166 and its assocaited shaft 178 to be moved in a linear direction represented by arrow 179. By applying DC power of the opposite polarity, motor M3 is caused to rotate in the opposite direction, causing pinion 174 to move rack 176 and shaft 178 in the opposite linear direction, as shown by arrow 181.

A bracket (not shown) is preferably provided and is secured to end 178*b* of shaft 178 to prevent the right-hand end 178*b* of shaft 178 from moving beyond key way opening 182*a*. A bracket 184 (see FIG. 2) is secured to the opposite end 178*c* of shaft 178 by suitable fastening means 185, and is further secured by suitable fastening means 186 to end 62*c* of card ejector member 62.

Reciprocating action of the ejector member 62 is accomplished by switching means 188, 190 and 192 shown in FIG. 5*a*, and which will be more fully described, controls reversal of the driving direction of motor M3 by controlling the polarity of the DC signal applied thereto. Switches 188 and 190 are positioned immediately above shaft 178 and are preferably microswitches having operating arms 188*a*, 190*a*. Switch 192 is positioned above shaft 178 a predetermined distance away from switches 188 and 190, as shown in FIG. 5*a*, and is provided with an operating arm 192*a*. A projection 194 is welded or otherwise secured to shaft 178, and is arranged to move back and forth with the reciprocating movement of shaft 178. When shaft 178 moves in the direction shown by arrow 179, projection 194 ultimately engages switch arm 192*a* causing operation of switch 192, which automatically reverses the direction of movement of shaft 178, as will be more fully described. When shaft 178 is moving in the direction shown by arrow 181, it engages and activates switch arms 188*a* and 190*a*, to cause a similar reversing operation as well as halting motor M3, as will be more fully described.

The operation of the automatic shuffler taken in consideration with FIGS. 1 through 5, and the schematic diagram shown in FIG. 6, is as follows:

Main switch 196 (see FIG. 1) is switched on to provide power to the apparatus 10. In one preferred embodiment, separate housing 13 (see FIG. 3*c*) is arranged to be releasably mechanically and electrically connected to rear wall 20. Housing 13 contains a battery pack for powering apparatus 10. Alternatively, unit 13 may comprise a power supply arranged for coupling with a local AC source for converting the 120 volt AC signal to 6 volts DC for powering the electrical and electronic members of the unit.

The group of cards to be shuffled are split into two groups, and a group is placed in each of the trays 24, 26. The cards block light from lamp 74, 76 from reaching the cooperating light-sensitive elements 78, 79. Momentary switch 202, when closed, delivers 6 volt DC power through line 204, switch 188 and line 206 through switch 202 to the first section or stage 208 of the electronic circuit, and which is coupled to common line 210.

If the cards C (see FIGS. 1 and 1*a*) are not in place, and the light ray 76 is not interrupted, relay 212 is not energized. However, if both trays 24, 26 are loaded with cards, the AND gate comprised of transistors Q1 and Q2 will be turned on, due to the increasing DC voltage level applied to their respective base electrodes. Thus, the level at the collector of Q1 goes substantially to ground, i.e., the level of ground return line 214, causing transistor Q3 to be turned off. The voltage at the collector of electrode Q3 goes high and through diode D1, triggers current generating type transistor Q4, which is preferably a Darlington transistor type D16 P (manufactured by General Electric). After a time delay of the order of two seconds, due to the timing circuit elements R7, C5, transistor Q4 is turned on and energizes relay 212. Switch arm 212*d* operates as a self-latching device and, upon energization of relay winding 212, moves to the dotted line position 212*d*′ to engage stationary contact 212*e* to deliver power to circuit section 208, and thereby latch in winding 212 after momentary switch 202 is released.

Switch arm 212*a* moves to dotted line position 212*a*′ upon energization of relay 212 to provide power from line 204 through line 214 contact arm 212*a*′ and contact 212*c* to simultaneously energize motors M1 and M2. Motor M1 (note FIGS. 3*b* and 3*c*) actuates the card mixing mechanism 32, causing rotation of members 34 and 36 and rollers 38 and 40 (see FIGS. 1 and 3*b*).

The cards in trays 24 and 26 are thus fed to card mixing assembly 32 in an alternating fashion, as was previously described. In the event that one tray is emptied before the other, section 208 provides a 5–7 second delay (depending on the voltage level of the power source) caused by the timing resistor R7 and timing capacitor C5, coupled in parallel between the base electrode of Q4 and ground return line 214 to hold transistor Q4 and hence relay 212 energized until the cards remaining in the other tray have been delivered to mixing device 32 and hence deposited within compartment 50.

At this time, light is no longer blocked from the sensors 78 and 79 turning the AND gate comprised of transistors Q1 and Q2 off. This turns Q3 on, which de-energizes Darlington transistor Q4 and hence relay 212 after termination of the aforementioned delay period.

The energization of relay 212 causes switch arms 212*d* and 212*a* to move to their solid line positions. Switch arm 212*d* disconnects power from section 208, while switch arm 212*b* disconnects power from motors M1 and M2 and couples power to the second stage or section 216 of the electronic circuit.

As was previously mentioned, motor M1 causes the cards in trays 24, 26 to be mixed and delivered to card stack compartment 50. The energization of motor M2 causes barrel 148 and hence carriage assembly 160 to continuously move up and down at a speed which is independent of the card mixing operation. When power is disconnected from motors M1 and M2, the mixing operation terminates after the aformentioned delay, as does the reciprocating movement of barrel 148, which terminates its reciprocating movement at a random location, hence stopping carriage assembly 162 at a random location.

The powering of second stage 216 powers lamp 82. However, if the stack of cards does not reach the height sufficient to cover sensor 86, stage 216 cannot operate, due to the fact that the voltage applied to the base electrode of Darlington transistor Q5 is insufficient to energize transistor Q5 and, hence prevents relay 218 from being energized. Once the stack of cards reaches a level sufficient to cover light-sensitive element 76, its resistance increases to provide an IR drop of a voltage sufficient to turn Q5 on, energizing relay 218. This causes switch arm 218*a* to move to the dotted line position 218*a*′ decoupling the line 204 from the line 206. Movement of the switch arm to the dotted line position 218*a*′ couples power from line 204 to a third circuit stage 220 including transistor Q6 and relay 222. Thus, the energization of relay 218 prevents motors M1 and M2 from being energized and provides power for energizing transistor Q6. The energization of relay 222 causes its switch arm 222*a* to move to the dotted line position 222*a*′ engaging contact 222*b* to energize relay 224. If desired, relay 222 can be eliminated from the circuit if relay 224 is rated 5 volts instead of 6 volts, and the emitter electrode of Q6 can be directly connected to relay 224, eliminating relay 222 and its movable and fixed contacts 222*a* and 222*b*.

The circuit 220 incorporating transistor Q6 is an automatic momentary switch which remains closed for a period of approximately one-half second the allow relay 224 to be self-latched, and to stop current flow through relay 218 until the randomly selected and ejected group of cards is removed and the light from source 82 in compartment 50 again reaches light-sensitive element 86 to turn Q5 off, and thereby de-energize relay 218.

Once relay 224 is momentarily energized, it self-latches by causing movable contact arm 224*a* to engage stationary contact 224*b*, establishing a circuit path through line 204 microswitch 192, contact 224*a* (in the dotted line position 224*a*') and contact 225*b* through relay winding 224 to ground return line 214.

Motor M3 is energized, receiving power through line 204, switch 190 switch arm 224*c* in dotted line position 224*c*' and stationary contact 224*d*, and further through switch arm 224*i*' and stationary contact 224*j* and switch arm 224*f* and stationary contact 224*e*.

Motor M3 is instantaneously energized, causing shaft 178 to move in the direction shown by arrow 179, which causes card ejector 62 to enter into the interior of compartment 50 through elongated opening 60, to push out a mixed group of cards from the stack in compartment 50. The height H of ejector 62 is preferably chosen to cause the number in the group of cards ejected to be substantially the equivalent of two full playing decks, or in the range from 80 to 120 playing cards.

At the same time, projection 194 moves away from microswitches 188 and 190 and toward microswitch 192. As soon as projection 194 is displaced from microswitches 188 and 190, which although reversing the switching state of motor M3, continues to deliver power to motor M3. Switch 188 interrupts the power line to circuit stage 210 to prevent accidental operation of motors M1 and M2. When projection 194 reaches microswitch 192, microswitch 192 is momentarily opened to interrupt the flow of self-locking current to relay 224. As relay 224 is energized, all four of its switch arms reverse from the normally-open to the normally-closed position. Relay switch arm 224*a* further interrupts the self-latching current path, and relay switch arm 224*c* moves to the solid line position to prevent the flow of current to motor M3 from line 204. After switch 190 reverses to the normally open state, relay switch arms 224*f* and 224*i* reverse the polarity of current to motor M3, causing card ejector 62 to be retracted from compartment 50. Member 194 moves away from microswitch 192 and toward microswitches 198 and 190, causing these switches to transfer to their normaly-open position. Switch 190 interrupts power to motor M3, causing it to stop. Switch 188 provides a closed circuit in preparation for reconnecting power to the first stage 210 of the electronic circuit.

The flexible rubber-like flanges 68, 70 yield as the group of cards is pushed out and partially displaced from the remainder of the stack in compartment 50, as shown in dotted fashion by card C' of FIG. 2. The flanges 68 and 70 further serve to prevent the portions of the stack above and below the group of cards displaced from the main body of the stack of cards from being displaced outwardly through the front opening of compartment 50.

After the displaced group of cards is manually removed from apparatus 10, the height of the stack of cards is reduced, enabling light-sensitive element 86 to receive light from light source 82, causing relay 212 to be de-energized to complete the electrical connection between power line 204 and the first stage 210 of the electronic circuit, through microswitch 188 and switch arm 218*a*, enabling circuit stage 208 to be restarted in readiness for a subsequent card selection operation.

As was described hereinabove, the randomness of the group of cards selected is provided by the independent operation of motor M2 to reciprocate carriage assembly 160 during the mixing operation. The random number of cards shuffled, circuit delays and mechanical delays, all contribute to the randomness of the selection of the cards from the stack.

As another alternative arrangement, relay 212 may be removed and replaced by resistor element $R_A$, as shown in FIG. 6*a* and Darlington transistor Q4 may be replaced by transistor Q4'.

When transistor Q4' is turned on, gate 236 is enabled, through inverter 240, passing pulses from high frequency oscillator 230 through AND gate 236 and OR gate 242 to clock N-stage counter 232, which may, for example, be a divide by 100 counter. Counter 232 continues to be incremented to its full count, reset and incremented time and time again at a very rapid rate, due to the high frequency pulses applied to clock rate, due to the high frequency pulses applied to clock input 232*a* from the high frequency oscillator 230, which may be operating at a value in the range of from 1 to 10 MHz.

As soon as transistor Q4' turns off, gate 236 is disabled, and gate 238 is enabled. Gate 236 blocks any further pulses from high frequency oscillator 230 from reaching counter 232. Gate 238 enables pulses from the extremely low frequency oscillator 234, which may be operating at a frequency in the order of 20 to 60 MHz, to be passed through gate 238 and OR gate 242 to clock counter 232. Gate 244 has its inverted input coupled to the output of inverter 240, and has its remaining input coupled to respective inputs of the stages of counter 232 and, for example, when inverter 240 changes state and counter 232 is reset to a zero count, gate 244 de-energizes relay 246 to open its switch arm 246*a* to de-energize motor M2 in a random manner.

Another alternative arrangement for accomplishing the same result is by coupling pushbutton switch 202 to the inputs of gates 236 and 238. Under normal operation, free-running high frequency oscillator 230 continues to clock counter 232. As soon as switch 202 is pressed, oscillator 230 is decoupled from counter 232, and low frequency oscillator 234 is coupled to counter 232. As soon as counter 232 steps to a count of zero, motor M2 is de-energized. Switch 202 may be provided with a self-latching relay 248 to close its switch arm 284*a* to lock in a signal to gates 236 and 238 for a period sufficient to allow counter 232 to step to a zero count. Relay 246 may be provided with an additional contact 246*b* for de-energizing relay 248 when counter 242 is stepped to a zero count. The functions accomplished by the circuitry shown in FIG. 6*a* may also be accomplished through the use of a microprocessor. The microprocessor crystal oscillator may serve as a high frequency oscillator 230, the output of the oscillator may be divided down to obtain a low frequency oscillator output. By a simple software program, one counter in the microprocessor may be continually clocked by the high frequency oscillator, while the microprocessor continually and regularly examines a signal such as, for example, the closure of switch 202, at which time clocking of the counter by the high frequency source is terminated and clocking of the counter by the low frequency source is initiated. The microprocessor examines the output of the counter, and as soon as it resets to zero, motor M2 is de-energized, causing the card ejector 62 to terminate its movement and occupy a randomly selected position.

FIG. *6b* shows another alternative electronic circuit, in which pulses from high frequency oscillator 230 are continuously passed by gate 231 to the clock input of N-stage counter 232. When start switch 202 is closed, gate 231 terminates clocking of counter 232. Digital to analog converter 233 converts the digital output (having a value between 0–100 in decimal notation) applying a DC voltage to one input of comparator 235. A small diameter gear 237 rotates with screw 144. Gear 237 meshes with and drives large diameter gear 239, which rotates the mechanical input to shaft angle to DC voltage converter 241. When the voltages applied to the inputs of comparator 235 compare, relay winding 243 is energized to decouple power from motor M2. The termination of pulses applied to counter 232 by high frequency generator 230 occurs in a purely random fashion, assuring a random selection of the position at which the card ejector is halted. Any of the circuit embodiments described herein may be employed, either with the embodiment of FIG. 8, or the embodiment of FIG. 7.

FIGS. 7 and 8 show another alternative embodiment 300 of the present invention in which the group of cards to be randomly selected from the card stack are automatically delivered to a card shoe. The assembly 300, shown in FIGS. 7 and 8, comprises a housing 12' similar to that shown in FIG. 1, but wherein certain features have been omitted for purposes of simplicity. The apparatus 300 includes trays 24' and 26' for receiving cards to be mixed. The mixed cards are delivered to compartment 50' in a manner similar to that described hereinabove in connection with the embodiment shown in FIGS. 1 through 5, except that the compartment depth is equal to the width of the playing cards, and the width of the compartment is equal to the length of the playing cards. The upper end 302*a* of the chute 302 covers the opening in compartment 50' and generally tapers downwardly to provide an outlet opening 302*b*, which communicates with the opening 304*a* in card dealing shoe 304. Cards C are urged towards the output delivery opening 304*b* in card shoe 304 by means of pressure plate 306, which is resiliently urged against the group of cards C by operating shaft 310 and resilient spring 308.

The arrangement of the carriage assembly 160' in the embodiment 300, as shown in FIGS. 7 and 8, is modified from that shown, for example, in FIG. *3a*, in that carriage assembly 160' moves rack 176' and shaft 178' in the direction shown by arrows 313 and 315, which directions are substantially parallel to side walls 16 and 18', whereas rack 176 and shaft 178, shown in FIG. *3a*, moves perpendicular to side walls 16 and 18. In addition, the card ejector 62', instead of entering through right-hand side wall 52', enters through opening 56*a'* in rear wall 56' and, instead of having a wedge-shape, member 62' is provided with a substantially flat front face and has a length substantially equal to the length of compartment 50', i.e., has a length which is substantially equal to the length of a playing card C.

Operation of the arrangement shown in FIG. 7 is substantially similar to that shown in FIGS. 1 through 6, except that an additional motor M4 is provided for operating pinion 318 for driving rack 310 in the direction shown by arrow 319 to move the pressure plate from the dotted line position 306' to the solid line position 306. This is accomplished during the time that the cards are being mixed and motor M4 may thus be coupled in parallel with motors M1 and M2.

As soon as all of the cards have been mixed and deposited in compartment 50' and light-sensitive element 86 has been covered by the stack of cards (see FIG. *2a*) and since barrel 148' and carriage 160' have halted at a randomly selected height, the motor M3 is energized causing rack 176' and shaft 178' and, hence card ejector 62', to move into card stack compartment 50' in the direction shown by arrow 313. The length of ejector 62' is sufficient to fully eject the selected group of cards from compartment 50' and to cause these cards to be moved downwardly through chute 302 and into card chute 304. As was the case with the embodiment shown in FIGS. 1 through 5, the thickness of ejector 62' is such as to cause ejection of a group of cards in the order of two playing decks.

Card ejector 62' is withdrawn from compartment 50' in the same manner as was previously described, and thereafter motor M4 is energized to move rack 310 in the direction shown by arrow 321 to return pressure plate 306 to the position 306'. Light source 324 and light-sensitive element 326 are utilized to prevent pressure plate 306 from being moved to the dotted line position 306' until all of the cards have been delivered to card dealing shoe 304 from chute 302.

A latitude of modification, change and substitution is intended in the foregoing disclosure, and in some instances, some features of the invention will be employed without a corresponding use of other features. Accordingly, it is appropriate that the appended claims be construed broadly and in a manner consistent with the spirit and scope of the invention herein.

What is claimed is:

1. Playing card apparatus comprising:

a vertically aligned compartment for receiving and stacking a large number of playing cards;

tray means arranged above said compartment for receiving playing cards to be shuffled;

shuffling means for shuffling playing cards delivered to said shuffling means from said tray means and for delivering shuffled cards downwardly into said compartment;

detection means responsive to emptying of said tray means for generating an output;

pusher means responsive to said output for pushing a portion of the stack in said compartment to displace said portion a predetermined distance from the remainder of the cards in the stack to facilitate gripping and manual removal of said displaced portion of the stack.

2. The playing card apparatus of claim 1, further comprising a moving means for moving said pusher means along one vertical side of said compartment during operation of said shuffling means; and means responsive to deactivation of said shuffling means for halting said moving means.

3. Playing card apparatus comprising:

a vertically aligned compartment for receiving and stacking playing cards;

tray means for receiving playing cards to be shuffled;

shuffling means for shuffling playing cards delivered to said shuffling means from said tray means and for delivering suffled cards to said compartment;

detection means responsive to emptying of said tray means for generating an output;

pusher means responsive to said output for pushing a portion of the stack in said compartment to displace said portion a predetermined distance from the remainder of the stack to facilitate removal of said displaced portion of the stack;

moving means for moving said pusher means along one vertical side of said compartment during operation of said shuffling means; and means responsive to deactivation of said shuffling means for halting said moving means;

said moving means comprises means for moving said pusher means along said one vertical side and means responsive to said pusher means reaching the upper and lower limits of said compartment for reversing the direction of travel said moving means moves said pusher means.

4. Playing card apparatus comprising:

a vertically aligned compartment for receiving and stacking playing cards;

tray means for receiving playing cards to be shuffled;

shuffling means for shuffling playing cards delivered to said shuffling means from said tray means and for delivering shuffled cards to said compartment;

detection means responsive to emptying of said tray means for generating an output;

pusher means responsive to said output for pushing a portion of the stack in said compartment to displace said portion a predetermined distance from the remainder of the stack to facilitate removal of said displaced portion of the stack;

said moving means being a reversible worm gear assembly.

5. The playing card apparatus of claim 4, wherein said worm gear assembly is comprised of an elongated rotatable shaft having first and second worm drives of opposing senses;

movable means cooperating with said shaft and being alternately driven in first and second directions by said worm drives.

6. The playing card apparatus of claim 5, wherein said moving means further comprises motor means for rotating said shaft and being energized substantially during operation of said shuffling means.

7. Playing card apparatus comprising:

a vertically aligned compartment for receiving and stacking playing cards;

tray means for receiving playing cards to be shuffled;

shuffling means for shuffling playing cards delivered to said shuffling means from said tray means and for delivering shuffled cards to said compartment;

detection means responsive to emptying of said tray means for generating an output;

pusher means responsive to said output for pushing a portion of the stack in said compartment to displace said portion a predetermined distance from the remainder of the stack to facilitate removal of said displaced portion of the stack;

said detection means comprising a light-sensitive element and a light source positioned to direct a light beam toward said light-sensitive element;

said light-sensitive element arranged in said tray means;

said light beam being blocked from reaching the light-sensitive element by playing cards placed in said tray means, and being unblocked when the cards in said tray have been transferred to said compartment;

means responsive to the condition of said light-sensitive element for controlling the push means.

8. Playing card apparatus comprising:

a vertically aligned compartment for receiving and stacking playing cards;

tray means for receiving playing cards to be shuffled;

shuffling means for shuffling playing cards delivered to said shuffling means from said tray means and for delivering shuffled cards to said compartment;

detection means responsive to emptying of said tray means for generating an output;

pusher means responsive to said output for pushing a portion of the stack in said compartment to displace said portion a predetermined distance from the remainder of the stack to facilitate removal of said displaced portion of the stack;

means for sensing movement of the pusher means into said compartment for moving said pusher means out of said compartment.

9. Playing card apparatus comprising:

a vertically aligned compartment for receiving and stacking playing cards;

tray means for receiving playing cards to be shuffled;

shuffling means for shuffling playing cards delivered to said shuffling means from said tray means and for delivering shuffled cards to said compartment;

detection means responsive to emptying of said tray means for generating an output;

pusher means responsive to said output for pushing a portion of the stack in said compartment to displace said portion a predetermined distance from the remainder of the stack to facilitate removal of said displaced portion of the stack;

a dealing shoe;

means for delivering cards ejected from said compartment to said dealing shoe.

10. The apparatus of claim 9, further comprising a pressure plate in said dealing shoe;

means responsive to a card ejecting operation for moving said pressure plate in a first direction to facilitate receipt of cards in aid shoe from said delivering means and movable in the reverse direction for returning the pressure plate to its original position.

11. Playing card apparatus comprising:

a vertically aligned compartment for receiving and stacking playing cards;

tray means for receiving playing cards to be shuffled;

shuffling means for shuffling playing cards delivered to said shuffling means from said tray means and for delivering shuffled cards to said compartment;

detection means responsive to emptying of said tray means for generating an output;

pusher means responsive to said output for pushing a portion of the stack in said compartment to displace said portion a predetermined distance from the remainder of the stack to facilitate removal of said displaced portion of the stack;

said pusher means comprising a wedge-shaped ejector member movable into said compartment and along a portion of one wall of said compartment;

means along a second portion of said one wall for displacing the cards in said compartment from the said one wall to enable said ejector means to move between said one wall and said cards for ejecting cards from said compartment.

12. The apparatus of claim 11, wherein the ejector member has a thickness sufficient to eject a group of cards from said compartment.

13. The apparatus of claim 12, wherein said thickness is sufficient to eject a group of cards substantially of the number of cards in two decks of playing cards.

14. The apparatus of claim 13, wherein the number of cards ejected by said ejector means is in the range of from 80 to 120 cards.

15. Playing card apparatus comprising:
- a vertically aligned compartment for receiving and stacking playing cards;
- tray means for receiving playing cards to be shuffled;
- shuffling means for shuffling playing cards delivered to said shuffling means from said tray means and for delivering shuffled cards to said compartment;
- detection means responsive to emptying of said tray means for generating an output;
- pusher means responsive to said output for pushing a portion of the stack in said compartment to displace said portion a predetermined distance from the remainder of the stack to facilitate removal of said displaced portion of the stack;
- said pusher means comprising motor means;
- a rack;
- a pinion linearly moving said rack, responsive to operation of said motor;
- an ejector member coupled to said rack for movement into said compartment.

16. The apparatus of claim 15, further comprising first and second limit switch means for reversing the polarity of the drive power coupled to said motor when a projection on said rack engages a limit switch for moving said ejector member into and out of said compartment.

17. The apparatus of claim 16, further comprising a carriage;
- said motor and said pinion gear being mounted upon said carriage;
- means on said carriage for slidably supporting said rack.

18. The apparatus of claim 17, wherein said moving means comprises a linearly movable member, secured to said carriage for moving said carriage.

19. Playing card apparatus comprising:
- a vertically aligned compartment for receiving and stacking playing cards;
- tray means for receiving playing cards to be shuffled;
- shuffling means for shuffling playing cards delivered to said shuffling means from said tray means and for delivering shuffled cards to said compartment;
- detection means responsive to emptying of said tray means for generating an output;
- pusher means responsive to said output for pushing a portion of the stack in said compartment to displace said portion a predetermined distance from the remainder of the stack to facilitate removal of said displaced portion of the stack;
- said detection means being arranged in said tray means for generating an output when cards are present in said tray means;
- a start button;
- activating means responsive to said detector means output and operation of said start button for activating said shuffling means.

20. The apparatus of claim 19, wherein said activating means further also activates said moving means.

21. The apparatus of claim 19, wherein said activating means is disabled by a second output produced by said means when there are no cards in said tray means, thereby deactivating said shuffling means and said moving means.

22. Random selection apparatus comprising a compartment for receiving and forming a stack of cards;
- pusher means for ejecting a portion of the stack from said compartment;
- means for delivering cards to said compartment;
- moving means responsive to operation of said delivering means for positioning said pusher means at a selected position along the height of said stack of cards;
- random positioning control means responsive to operation of said delivering means for halting said moving means at a randomly selected position;
- means responsive to the halting of said moving means for energizing said pusher means.

23. The apparatus of claim 22, further comprising:
- sensing means for preventing operation of said pusher means when said stack of cards is less than a predetermined height.

24. The apparatus of claim 22, wherein said random positioning control means comprises:
- an N-stage counter;
- a high frequency generator means for incrementing said counter;
- low frequency generating means for incrementing said counter;
- means normally coupling said high frequency generating means to said counter, and responsive to operation of said delivering means for decoupling said counter from said high frequency generating means, and for coupling said counter to said low frequency generating means.

25. The apparatus of claim 24, wherein said positioning control means further comprises means responsive to resetting of said counter by said low frequency generating means for deactivating said moving means.

26. The apparatus of claim 25, wherein said means responsive to resetting of said counter comprises gate means coupled to the counter for deactivating said moving means when said counter is reset.

27. The apparatus of claim 22, wherein said high frequency generating means has an operating frequency in the range from 0.5 to 5 megahertz.

28. The apparatus of claim 27, wherein the low frequency generating means operates in the range of the order of twenty to two hundred hertz.

29. The apparatus of claim 22, wherein said random positioning control means comprises:
- a counter;
- a first high frequency generating means for incrementing said counter;
- a second low frequency generating means for incrementing said counter;
- means normally coupling said first generating means to said counter, and responsive to operation of said delivering means by a start switch for decoupling said first generating means from said counter and coupling said counter to said second generating means to.

30. The apparatus of claim 22, further comprising means for converting the output of said counter to a DC level;
- means for generating a DC level representative of the position of said moving means;
- means for halting said moving means when said DC levels compare.

31. The apparatus of claim 30, wherein said moving means comprises a reversible worm screw drive;
- said converting means comprising means responsive to rotation of said worm screw drive for converting the angular position of said worm screw drive into a DC level.

* * * * *